US008992637B2

(12) United States Patent
Baldrey et al.

(10) Patent No.: US 8,992,637 B2
(45) Date of Patent: Mar. 31, 2015

(54) REMOTE ADDITIVE APPLICATION

(75) Inventors: Kenneth E. Baldrey, Denver, CO (US); Ramon E. Bisque, Golden, CO (US); Michael D. Durham, Castle Rock, CO (US)

(73) Assignee: ADA-ES, Inc., Littleton, CO (US)

( * ) Notice: Subject to any disclaimer, the term of this patent is extended or adjusted under 35 U.S.C. 154(b) by 428 days.

(21) Appl. No.: 13/366,985

(22) Filed: Feb. 6, 2012

(65) Prior Publication Data

US 2012/0216729 A1 Aug. 30, 2012

Related U.S. Application Data

(60) Provisional application No. 61/439,676, filed on Feb. 4, 2011.

(51) Int. Cl.

| | |
|---|---|
| ***C10L 5/00*** | (2006.01) |
| ***C10L 10/02*** | (2006.01) |
| ***C10K 1/00*** | (2006.01) |
| ***C10L 9/10*** | (2006.01) |

(52) U.S. Cl.

CPC ..... *C10L 10/02* (2013.01); *C10K 1/007* (2013.01); *C10L 9/10* (2013.01); *C10J 2300/0983* (2013.01); *C10L 2200/025* (2013.01)

USPC ..... 44/620; 44/621; 423/210

(58) Field of Classification Search

USPC ..... 44/620, 621; 423/210

See application file for complete search history.

(56) References Cited

U.S. PATENT DOCUMENTS

| | | | | |
|---|---|---|---|---|
| 4,224,039 | A | 9/1980 | Smith et al. | |
| 2006/0185226 | A1 | 8/2006 | McDonald et al. | |
| 2008/0107579 | A1 * | 5/2008 | Downs et al. | 423/210 |
| 2010/0284872 | A1 * | 11/2010 | Gale et al. | 423/215.5 |

OTHER PUBLICATIONS

International Search Report for International Patent Application No. PCT/US12/23990, mailed May 23, 2012, 3 pages.

Written Opinion for International Patent Application No. PCT/US12/23990, mailed May 23, 2012, 4 pages.

* cited by examiner

*Primary Examiner* — Cephia D Toomer

(74) *Attorney, Agent, or Firm* — Sheridan Ross P.C.

(57) ABSTRACT

The present disclosure is directed to the application of additives to a feed material at a location remote from an industrial facility using the feed material.

20 Claims, 2 Drawing Sheets

REPLACEMENT SHEET

REMOTE ADDITIVE APPLICATION

CROSS REFERENCE TO RELATED APPLICATION

The present application claims the benefits of U.S. Provisional Application Ser. No. 61/439,676, filed Feb. 4, 2011 of the same title, which is incorporated herein by this reference in its entirety.

FIELD

The disclosure relates generally to feed material additives and particularly to application of additives remote from a site of use of the feed material.

BACKGROUND

In response to the acknowledged threat that mercury poses to human health and the environment as a whole, both federal and state/provincial regulation have been implemented in the United States and Canada to permanently reduce mercury emissions, particularly from coal-fired utilities (e.g., power plants), cement kilns, waste incinerators and boilers, industrial coal-fired boilers, and other coal combusting facilities. For example, about 40% of mercury introduced into the environment in the U.S. comes from coal-fired power plants. New coal-fired power plants will have to meet stringent new source performance standards. In addition, Canada and more than 12 states have enacted mercury control rules with targets of typically 90% control of coal-fired mercury emissions and other states are considering regulations more stringent than federal regulations. Further U.S. measures will likely require control of mercury at more stringent rates as part of new multi-pollutant regulations for all coal-fired sources.

The leading technology for mercury control from coal-fired power plants is activated carbon injection ("ACI"). ACI is the injection of powdered carbonaceous sorbents, particularly powdered activated carbon ("PAC"), upstream of either an electrostatic precipitator or a fabric filter bag house. Activated or active carbon is a porous carbonaceous material having a high absorptive power.

Activated carbon can be highly effective in capturing oxidized (as opposed to elemental) mercury. Most enhancements to ACI have used halogens to oxidize gas-phase elemental mercury so it can be captured by the carbon surface. ACI technology has potential application to the control of mercury emissions on most coal-fired power plants, even those plants that may achieve some mercury control through control devices designed for other pollutants, such as wet or dry scrubbers for the control sulfur dioxide.

ACI is a low capital cost technology. The largest cost element is the cost of sorbents. However, ACI has inherent disadvantages that are important to some users. First, the carbon can limit or prevent the plant owner from selling the fly ash as a replacement for Portland cement in the manufacture of concrete. Second, ACI is normally not effective at plants configured with hot-side electrostatic precipitators or higher temperature cold-side electrostatic precipitators, because the temperature at which the particulates are collected is higher than the temperature at which the carbon adsorbs the oxidized mercury. Finally, activated carbon is less effective for plants firing high sulfur coal and plants using sulfur trioxide flue gas conditioning due to the interference of sulfur trioxide with capture of mercury on the carbon surface.

Another technique to control mercury emissions from coal-fired power plants is bromine injection with ACI. Such a mercury control system is sold by Alstom Power Inc. under the tradenames Mer-Cure™ or KNX™. Bromine is believed to oxidize elemental mercury and form mercuric bromide. To remove mercury effectively, bromine injection is done at high rates, typically above 100 ppmw of the coal depending on the carbon injection rate. At 100 ppmw without ACI, bromine has been reported as removing only about 40% of the mercury.

While halogen addition has proven effective in controlling mercury emissions, halogen addition can be cost prohibitive in some applications due to high transportation and material handling costs.

SUMMARY

These and other needs are addressed by the various aspects, embodiments, and configurations of the present disclosure. The aspects, embodiments, and configurations are directed generally to the conversion of gas-phase contaminants, such as mercury, to a form that is more readily captured.

In one aspect, a method is provided that includes the steps:

(a) at first location, receiving a treated feed material comprising a feed material and an additive; and (b) loading the treated feed material for transportation to a second location, the second location being located discretely from the first location, wherein the treated feed material is heated at the second location to generate a gas stream.

In yet a further aspect, a method is provided that includes the steps:

(a) receiving, at an industrial facility, a treated feed material comprising a mercury-containing feed material and a halogen-containing additive, wherein the treated feed material was transported to the industrial facility from a remote location located discretely from the industrial facility; and (b) generating, by the industrial facility and from the treated feed material, a gas stream comprising mercury and the halogen, the halogen facilitating or enabling removal of at least most of the mercury from the waste gas.

The additive can serve one or more useful functions, such as adjusting a physical property (e.g., melting temperature, combustion temperature, chemical composition, unburned particulate property, miscibility of components of the feed material, and evolved gas stream composition) or contaminant treatment and/or removal. In one application, the contaminant comprises mercury and the additive is a halogen. The halogen enables or facilitates removal of at least about 50% or more of the elemental and/or speciated mercury from the gas stream.

In yet a further aspect, a method is provided that includes the steps:

(a) agglomeration, at a first location, of an additive and a feed material to form additive-containing agglomerates; and (b) loading the agglomerates for transportation to a second location, the second location being located discretely from the first location, wherein the treated feed material is processed at the second location to generate a gas stream, optionally containing the additive.

In yet a further aspect, a method is provided that includes the step:

(a) processing an additive-containing agglomerate and a feed material to produce a gas stream, the additive controlling emission of a target material and/or a physical property of the feed material.

The target material can be any environmentally controlled material, including an acid gas (e.g., HCl and/or $SO_x$), mercury, and particulates. Examples of additives for controlling target material emissions include halogens, halides, and interhalogen compounds, sodium, calcium, and/or lime.

In one configuration, the halogen is added substantially above, more commonly at least about 25% above, more commonly at least about 50% above, more commonly at least about 75% above, more commonly at least about 100% above, more commonly at least about 150%, and even more commonly at least about 250% above a level of native selected halogen (typically bromine and/or iodine) in the feed material.

In one configuration, the feed material is coal, and the coal natively includes commonly from about 0 to about 250 and more commonly from about 1 to about 100 ppm bromine and/or iodine. The mean or median bromine and/or iodine concentration of the coal is from about 5 to about 100 ppm. Lignite coals are generally at the lower end of the range while bituminous coals are at the upper end of the range. Sub bituminous coals fall within the range. Chlorine content is typically higher. Coal natively includes commonly from about 0 to about 2,500 and more commonly from about 1 to about 2,000 ppm bromine and/or iodine. The mean or median chlorine concentration of the coal is from about 50 to about 1,000 ppm.

The present disclosure can provide a number of advantages depending on the particular configuration. Application of the additive at the mine site can reduce equipment requirements and operating costs at the site of end use. In particular, it can significantly reduce transportation and material handling costs.

These and other advantages will be apparent from the disclosure of the aspects, embodiments, and configurations contained herein.

"A" or "an" entity refers to one or more of that entity. As such, the terms "a" (or "an"), "one or more" and "at least one" can be used interchangeably herein. It is also to be noted that the terms "comprising", "including", and "having" can be used interchangeably.

"A" or "an" entity refers to one or more of that entity. As such, the terms "a" (or "an"), "one or more" and "at least one" can be used interchangeably herein. It is also to be noted that the terms "comprising", "including", and "having" can be used interchangeably.

"Absorption" is the incorporation of a substance in one state into another of a different state (e.g. liquids being absorbed by a solid or gases being absorbed by a liquid). Absorption is a physical or chemical phenomenon or a process in which atoms, molecules, or ions enter some bulk phase—gas, liquid or solid material. This is a different process from adsorption, since molecules undergoing absorption are taken up by the volume, not by the surface (as in the case for adsorption).

"Adsorption" is the adhesion of atoms, ions, biomolecules, or molecules of gas, liquid, or dissolved solids to a surface. This process creates a film of the adsorbate (the molecules or atoms being accumulated) on the surface of the adsorbent. It differs from absorption, in which a fluid permeates or is dissolved by a liquid or solid. Similar to surface tension, adsorption is generally a consequence of surface energy. The exact nature of the bonding depends on the details of the species involved, but the adsorption process is generally classified as physisorption (characteristic of weak van der Waals forces)) or chemisorption (characteristic of covalent bonding). It may also occur due to electrostatic attraction.

"Ash" refers to the residue remaining after complete combustion of the coal particles. Ash typically includes mineral matter (silica, alumina, iron oxide, etc.).

"At least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

"Binder" refers to an additive to a material being agglomerated that produces a bonding strength in the final product. A binder can be a liquid or solid that forms a bridge, film, or matrix filler or that causes a chemical reaction.

"Biomass" refers to biological matter from living or recently living organisms. Examples of biomass include, without limitation, wood, waste, (hydrogen) gas, seaweed, algae, and alcohol fuels. Biomass can be plant matter grown to generate electricity or heat. Biomass also includes, without limitation, plant or animal matter used for production of fibers or chemicals. Biomass further includes, without limitation, biodegradable wastes that can be burnt as fuel but generally excludes organic materials, such as fossil fuels, which have been transformed by geologic processes into substances such as coal or petroleum. Industrial biomass can be grown from numerous types of plants, including miscanthus, switchgrass, hemp, corn, poplar, willow, sorghum, sugarcane, and a variety of tree species, ranging from eucalyptus to oil palm (or palm oil).

"Coal" refers to a combustible material formed from prehistoric plant life. Coal includes, without limitation, peat, lignite, sub-bituminous coal, bituminous coal, steam coal, anthracite, and graphite. Chemically, coal is a macromolecular network comprised of groups of polynuclear aromatic rings, to which are attached subordinate rings connected by oxygen, sulfur, and aliphatic bridges.

"Halogen" refers to an electronegative element of group VIIA of the periodic table (e.g., fluorine, chlorine, bromine, iodine, astatine, listed in order of their activity with fluorine being the most active of all chemical elements).

"Halide" refers to a binary compound of the halogens.

"High alkali coals" refer to coals having a total alkali (e.g., calcium) content of at least about 20 wt. % (dry basis of the ash), typically expressed as CaO, while "low alkali coals" refer to coals having a total alkali content of less than 20 wt. % and more typically less than about 15 wt. % alkali (dry basis of the ash), typically expressed as CaO.

"High iron coals" refer to coals having a total iron content of at least about 10 wt. % (dry basis of the ash), typically expressed as $Fe_2O_3$, while "low iron coals" refer to coals having a total iron content of less than about 10 wt. % (dry basis of the ash), typically expressed as $Fe_2O_3$. As will be appreciated, iron and sulfur are typically present in coal in the form of ferrous or ferric carbonates and/or sulfides, such as iron pyrite.

"High sulfur coals" refer to coals having a total sulfur content of at least about 1.5 wt. % (dry basis of the coal) while "medium sulfur coals" refer to coals having between about 1.5 and 3 wt. % (dry basis of the coal) and "low sulfur coals" refer to coals having a total sulfur content of less than about 1.5 wt. % (dry basis of the coal).

Neutron Activation Analysis ("NAA") refers to a method for determining the elemental content of samples by irradiating the sample with neutrons, which create radioactive forms of the elements in the sample. Quantitative determination is achieved by observing the gamma rays emitted from these isotopes.

"Particulate" refers to fine particles, such as fly ash, unburned carbon, soot and fine process solids, typically entrained in a mercury-containing gas stream.

The phrase "ppmw X" refers to the parts-per-million, based on weight, of X alone. It does not include other substances bonded to X.

The unit μg/wscm refers to a weight of vapor-phase mercury contained per standard cubic meter of mercury-containing gas, measured on a wet basis.

"Separating" and cognates thereof refer to setting apart, keeping apart, sorting, removing from a mixture or combination, or isolating. In the context of gas mixtures, separating can be done by many techniques, including electrostatic precipitators, baghouses, scrubbers, and heat exchange surfaces.

A "sorbent" is a material that sorbs another substance; that is, the material has the capacity or tendency to take it up by sorption.

"Sorb" and cognates thereof mean to take up a liquid or a gas by sorption.

"Sorption" and cognates thereof refer to adsorption and absorption, while desorption is the reverse of adsorption.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Figure 1:
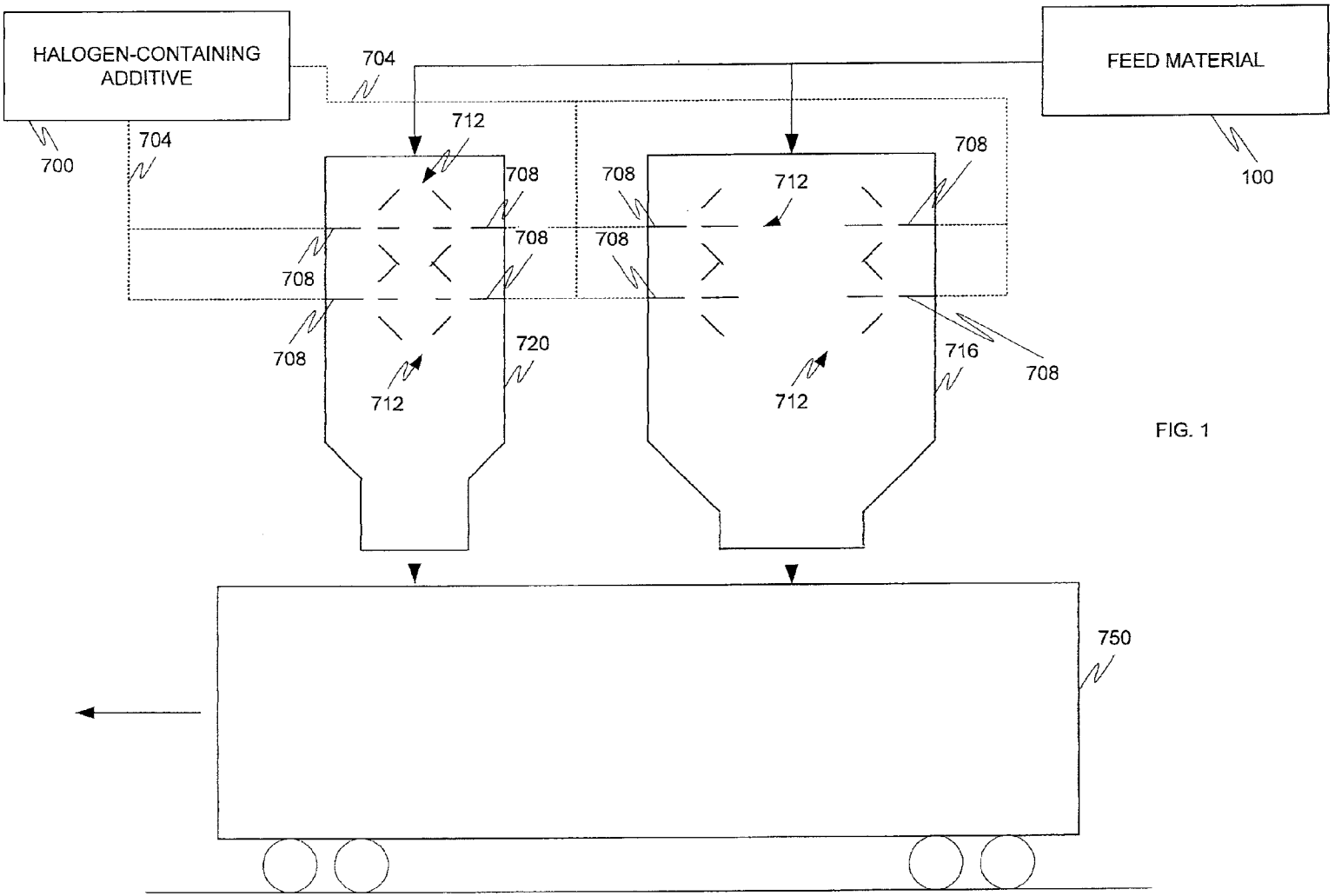
FIG. 1 is a block diagram according to an embodiment.

Although the embodiments below are discussed with specific reference to halogen additives, it is to be understood that the embodiments apply equally to other additives, as discussed below.

An exemplary feed material treatment or industrial facility will be discussed. It is to be understood that any type of industrial facility may benefit from the teachings of this disclosure.

The feed material, in one application, natively includes, without limitation, varying levels of halogens and mercury. Typically, the feed material includes typically at least about 0.001 ppmw, even more typically from about 0.003 to about 100 ppmw, and even more typically from about 0.003 to about 10 ppmw mercury (both elemental and speciated) (measured by neutron activation analysis ("NAA")). Commonly, a combustible feed material includes no more than about 5 ppmw iodine, more commonly no more than about 4 ppmw iodine, even more commonly no more than about 3 ppmw iodine, even more commonly no more than about 2 ppmw iodine and even more commonly no more than about 1 ppmw iodine (measured by neutron activation analysis ("NAA")). A combustible feed material generally will produce, upon combustion, an unburned carbon ("UBC") content of from about 0.1 to about 30% by weight and even more generally from about 0.5 to about 20% by weight.

The feed material is combusted in a thermal unit to produce a mercury-containing gas stream. The thermal unit can be any combusting device, including, without limitation, a dry or wet bottom furnace (e.g., a blast furnace, puddling furnace, reverberatory furnace, Bessemer converter, open hearth furnace, basic oxygen furnace, cyclone furnace, stoker boiler, cupola furnace and other types of furnaces), boiler, incinerator (e.g., moving grate, fixed grate, rotary-kiln, or fluidized or fixed bed, incinerators), calciners including multi-hearth, suspension or fluidized bed roasters, intermittent or continuous kiln (e.g., ceramic kiln, intermittent or continuous wood-drying kiln, anagama kiln, bottle kiln, rotary kiln, catenary arch kiln, Feller kiln, noborigama kiln, or top hat kiln), oven, or other heat generation units and reactors.

The mercury-containing gas stream includes not only elemental and/or speciated mercury but also a variety of other materials. A common mercury-containing gas stream includes at least about 1 μg/wscm, even more commonly at least about 3 μg/wscm, and even more commonly from about 5 to about 20 μg/wscm mercury (both elemental and speciated). Other materials in the mercury-containing gas stream can include, without limitation, particulates (such as fly ash), sulfur oxides, nitrogen oxides, carbon oxides, unburned carbon, and other types of particulates.

The temperature of the mercury-containing gas stream varies depending on the type of thermal unit employed. Commonly, the mercury-containing gas stream temperature is at least about 125° C., even more commonly is at least about 325° C., more commonly is no more than about 1,000° C., and even more commonly ranges from about 325 to about 500° C. Such temperatures normally exist at or upstream of the inlet of the particulate control device.

The mercury-containing gas stream is optionally passed through a preheater to transfer some of the thermal energy of the mercury-containing gas stream to air input to the thermal unit. The heat transfer produces a common temperature drop in the mercury-containing gas stream of from about 50 to about 300° C. to produce a mercury-containing gas stream temperature commonly ranging from about 100 to about 400° C.

The mercury-containing gas stream is next subjected to a particulate removal device 120 to remove most of the particulates from the mercury-containing gas stream and faun a treated mercury-containing gas stream. The particulate removal device can be any suitable device, including an electrostatic precipitator, particulate filter such as a baghouse, wet particulate scrubber, and other types of particulate removal devices.

The treated gas stream is emitted, via gas discharge, into the environment. In one embodiment shown in FIG. 1, a halogen-containing additive 700 is contacted with the feed material 100 at a location remote or discrete from the industrial facility producing a gas stream. The location may be at the mine or waste site where the feed material 100 is removed, at a transload facility located between the mine or waste site and the industrial facility, at a coal blending location between the mine site and the industrial facility, and/or at another location between the mine or waste site and the industrial facility. Although it is possible to apply a first part of the halogen-containing additive 700 remotely from the industrial facility and a second part at the industrial facility, typically at least most, more typically at least about 75%, and even more typically at least about 95% of the additive 700 is contacted with the feed material 100 at one or more locations remote from the industrial facility. This has the advantage of using the natural mixing of the feed material resulting from handling and/or transporting of the feed material 100 to provide a more homogenous distribution of the additive 700 throughout the feed material 100.

The additive 700, which may be composed primarily of bromine or a mixture of iodine and bromine, can be in the form of a solid, liquid, or vapor. When in the form of a solid or liquid, in one configuration the additive may be agglomerated, optionally on combustible substrate particles, and added to the feed material 100. A polymeric or non-polymeric or organic or inorganic binder may be employed to provide more robust agglomerates and inhibit loss of the additive 700 in transit. The polymeric or non-polymeric or organic or inorganic binder may be any organic material that, when combusted, will not introduce toxic or otherwise controlled substances into the waste gas 108. Binders generally fall into four classes. A first class is a matrix binder that is a solid or semi-solid, such as tar, pitch, asphalt, wax, or cement. A second type is a film binder, such as water, solutions, dispersions, powders, silicate gel, oil, alcohol, clay and starch. Chemical binders, the third class, react chemically with the material being agglomerated. Examples of chemical binders include, without limitation, silicate, acid, molasses, lime, and lignosulfonate. Lubricant binders reduce friction and induce flow of the material to be agglomerated. Examples of lubricants include, without limitation, oil, glycerin, stearate, and wax. Particularly beneficial binders include, without limitation, hydrocarbons, silica, silicates, and clays. In another configuration, the additive 700 is in the form of a free flowing, finely-sized powder that is mixed with the feed material 100. The mean, median, and $P_{90}$ sizes of the powder are generally no larger than the corresponding size of the feed material 100 particles.

Agglomeration is performed by known techniques. In one configuration, a portion of the feed material particles (or carrier material) are mixed with the binder and halogen-containing additive 700 to form a binder mixture. In another configuration, the binder mixture is formed by mixing the binder and halogen-containing additive 700 with a carrier material other than the feed material, such as fly ash, coke, carbon dust, clay, metal additives, arc furnace dust, and coal dust, flux, iron fines, or iron powder. The amount of binder commonly depends on the feed material surface type and/or area, percent moisture, density of particles to be agglomerated, method of curing, chemical composition, and method of agglomeration. Generally, the binder is from about 0.5 to about 25 and even more generally from about 1 to about 15% by weight of the binder mixture. The binder mixture can be agglomerated by briquetting, pelletizing, granulation, compaction, extrusion, and tableting. The agglomerate may need to be dehydrated in a drying or settling process and/or cured at elevated temperatures.

The binder mixture may include other additives. A settling agent, for example, is required where one or more components of the binder mixture are insoluble. The binder mixture typically includes from about 1 to about 50 and even more typically from about 5 to about 25% by weight settling agent. Generally, the setting agent is added to the material to be agglomerated before the binder itself. Examples of setting agents include, without limitation, inorganic salts (e.g., gypsum salts, calcium hydroxide, calcium carbonate, $NaH_2BO_3$, $KHSO_4$, calcium sulfate, calcium chloride, magnesium hydroxide, sodium carbonate, and aluminum sulfate), inorganic acids (particularly mineral acids), inorganic oxides (e.g., zinc oxide, calcium oxide, and magnesium oxide), stabilizers (e.g., Portland cement, fly ash, slag cement, and clays), organic acids (acetic acid and formic acid), organic (aliphatic) esters or amides (e.g., formamide, acetates, acetins, glyoxal, and dibasic esters), organic carbonates and alcohols (e.g., ethylene glycol and propylene glycol), other suitable materials (e.g., molasses, dextrin, silanes, starch, glucose, and soium silicofluoride), and mixtures thereof. As will be appreciated, the setting agent may also act as the binder in some formulations.

Figure 2:
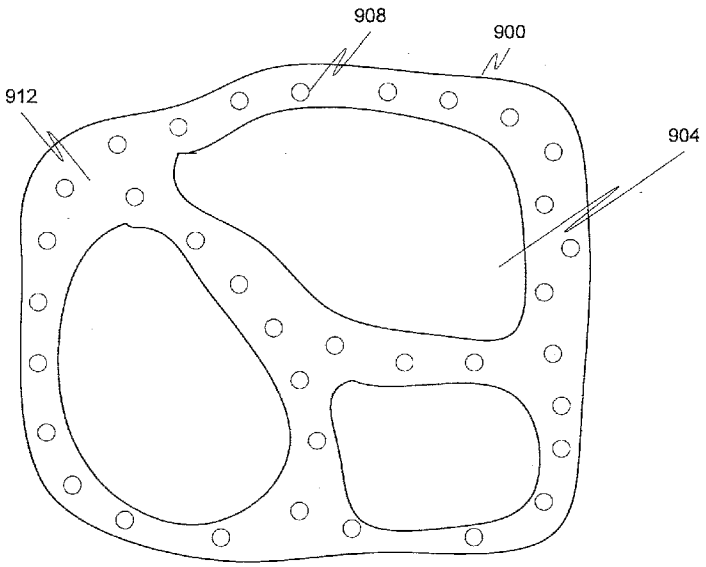
FIG. 2 is a sectional view of an agglomerated particle.

FIG. 2 is a sectional view of an agglomerated particle 900. The particle 900 includes one or more carrier particles 904 and additive particles 908 bound together by binder 912. When the agglomerated particle 900 is combusted, the additive particles 908 are released into the gas atmosphere in the furnace and into the waste gas.

In another embodiment, additives other or in addition to the halogen-containing additive are agglomerated at the mine site or a load transfer stage for delivery to a waste gas generating facility, such as a utility, incinerator, and the like. The additive can control emission of a target material and/or a combustion characteristic of the feed material. The target material can be any environmentally controlled material, including an acid gas (e.g., HCl and $SO_x$), mercury, and particulates. Examples of additives for controlling target material emissions include not only halogens, halides, and inter-halogen compounds, but also sodium, calcium oxide, calcium hydroxide, calcium carbonate, and metal oxide. The combustion characteristic can be, for example, combustion temperature, and degree of combustion.

The halogen-containing additive 700 can include, without limitation, stabilizing agents to stabilize the additive 700 during transit. Exemplary stabilizing agents include, without limitation, dust control agents and freeze control agents.

A particular mine site configuration is depicted in FIG. 1. While the figure depicts a rail loading facility, it is to be appreciated that other types of loading facilities may be modified as disclosed herein. Other types of loading facilities include, without limitation, truck, barge, or ship loading facilities.

The feed material 100 is loaded into primary and secondary hoppers 716 and 720. The primary hopper 716 has a larger volume than the secondary hopper 720 as the feed material 100 in the primary hopper 716 fills most of the rail car 750 while the secondary hopper 720 tops off the car 750. During or after loading of the feed material 100 into the primary and secondary hoppers 716 and 720, a plurality of nozzles 708 in each hopper 716 and 720 sprays 712 the halogen-containing additive 700 onto the feed material 100. The nozzles 708 are in fluid communication with a reservoir or storage vessel for the halogen-containing additive 700 via a plurality of conduits 704. When the car 750 is properly positioned under the primary and secondary hoppers 716 and 720, valves (not shown) at the bottom of each hopper are sequentially opened, and the feed material 100 is loaded into the car. During loading, the portion of the feed material 100 containing the halogen-containing additive 700 will be further and more intimately mixed or blended with the portion of the feed material 100 not containing the halogen-containing additive 700. Further mixing will occur when the feed material 100 in the rail car 750 is unloaded and stockpiled at the industrial facility and when the feed material 100 is removed from the stockpile, such as by a conveyor belt, optionally further comminuted (e.g., milled), and fed to the thermal combustor 104.

When combusted, the halogen in the halogen-containing feed material will effect or contribute to removal of elemental mercury, particularly at flue gas temperatures below about 725° C. When halogen-containing feed material is combusted to form a mercury-containing gas stream in which elemental or metallic mercury is the stable species. The stable form of the halogens at the high combustion temperature is believed to be the formation of acids (HCl, HBr, and HI). While not wishing to be bound by any theory, on cooling of the mercury-containing gas stream, the diatomic, molecular form of the halogens is believed to become stable according to the Deacon type of reactions:

$$4HCl+O_2 \rightarrow 2H_2O+Cl_2 \quad (1)$$

$$4HBr+O_2 \rightarrow 2H_2O+Br_2 \quad (2)$$

The conversion of bromine is believed to start at a higher temperature than the corresponding conversion of chlorine; therefore, the kinetics of the Deacon reaction are more favorable.

Moreover, molecular chlorine (but not molecular bromine) is consumed during furnace passage by SO2 in the chlorine Griffin reaction as follows:

$$SO_2+Cl_2 \rightarrow SO_3+2HCl \quad (3)$$

Molecular bromine, as shown below, is not believed to be consumed by $SO_2$ within the boiler temperature range:

$$SO_2+Br_2 \leftarrow SO_3+2HBr \quad (4)$$

Downstream of the combustion zone, there is believed to be much more molecular bromine as compared to the corresponding quantities of molecular chlorine. Surprisingly, the chlorine content of coal is much higher than its bromine content, the amount of molecular bromine ($Br_2$) in the mercury-containing gas stream gas is commonly higher than the amount of molecular chlorine ($Cl_2$) in the gas downstream of the combustion zone. Almost all chlorine is believed to be in the form of HCl at the boiler back end.

EXPERIMENTAL

The following examples are provided to illustrate certain aspects, embodiments, and configurations of the disclosure and are not to be construed as limitations on the disclosure, as set forth in the appended claims. All parts and percentages are by weight unless otherwise specified.

A trial of mercury control when firing an iodine treated coal was completed on a 70 MW, wall-fired unit firing a Powder River Basin coal. The purpose of this test was to compare the mercury removal of the treated coal product on mercury emissions compared to the identical coal at the same process conditions without treatment. The trial was also structured to test the effectiveness of iodine coal treatment at a remote site with typical long distance rail shipping The coal was treated at the mine load out by application of an aqueous iodine-containing solution by spray contact with the coal in an overhead loading hopper as the coal was being added to each rail car. A unit train was loaded with about half untreated and half treated coal. The level of treatment based on coal weight and chemical applied was 7.6 ppmw of iodine in the as-loaded coal. The concentrated chemical spray was applied to substantially all of the coal and was well-distributed.

The coal was shipped from the mine to the power plant with a transit time of five days. During transit, there was inclement weather and periods of continuous rain, therefore some of the soluble additive could have leached from the treated coal. At the power plant, the untreated coal from this unit train was fired for six days and then the first treated coal was introduced. Treated coal was then burned exclusively in this unit for another seven days.

Coal samples taken at the plant from the coal feed to the boiler were analyzed for halogen content by neutron activation analysis (NAA). Samples during the baseline period averaged 26.0 μg/g chlorine as-received, 1.2 μg/g bromine and 0.4 μg/g iodine. Samples taken while firing treated coal averaged 18.9 μg/g chlorine as-received, 1.1 μg/g bromine and 3.0 μg/g iodine. The results for iodine indicated loss during transit and handling (7.6 μg/g as loaded and 3.0 as-received). However, the coal sampling and analytical frequency was lower than necessary to conclusively determine this.

The plant pollution control equipment consisted of a cold-side electrostatic precipitator operating at an inlet flue gas temperature of 360° F. to 400° F. The level of unburned carbon (loss-on-ignition) was 0.7% or essentially none in the PRB fly ash. In addition, the mercury speciation as measured by the outlet mercury monitor was initially almost all elemental mercury. These conditions are expected to be extremely problematic for conventional mercury control such as activated carbon injection (ACI) or bromine treatment of coal. For ACI, the temperature was too high for substantial elemental mercury sorption except at higher injection rates with halogenated activated carbon. This would be expensive and would add carbon detrimentally into the fly ash. Bromine treatment of coal would be expected to increase the oxidation of mercury when applied as typically practiced at 30 to 100 ppm on the coal, but the lack of unburned carbon in the fly ash would limit capture of the oxidized mercury species.

A modular rack mercury continuous emission monitor (HG-CEM) was installed at the ESP outlet (ID fan inlet) to measure the total and elemental mercury in the flue gas. The monitor directly reads mercury concentration in the flue gas on one-minute average intervals in units of micrograms mercury per standard cubic meter of flue gas, wet basis (μg/wscm).

The treated coal first reached the boiler from only one of 3 bunkers and the mercury concentration at full load rapidly decreased from 5 to 2.6 μg/wscm in the flue gas) or about 50% reduction. After all the coal feed switched to treated, the mercury decreased slightly more and remained lower. Overall, the average baseline mercury concentration measured at the stack outlet when initially burning the coal with no iodine treatment was about 5.5 lb/TBtu (0.0045 ppmw) at high load above 70 MW and 1.7 μg/wscm at low load of about 45 MW. When firing treated coal, the high load Hg concentration averaged about 2.6 μg/wscm and the low load about 0.8 μg/wscm The use of treated coal reduced mercury emission by about 53%. In addition, episodes of extreme mercury spikes during high temperature excursions related to soot blowing were substantially eliminated. After the unit came back from an outage, the regular coal feed (untreated) was resumed and the mercury emissions returned to baseline of about 5.5 μg/wscm at full load.

In order to further validate the mercury measurements, a set of independent emissions tests were completed using a sorbent trap method (EPA Method 30B). The sorbent trap emissions agreed well with the Hg-CEM throughout the trial.

A number of variations and modifications of the disclosure can be used. It would be possible to provide for some features of the disclosure without providing others.

The present disclosure, in various aspects, embodiments, and configurations, includes components, methods, processes, systems and/or apparatus substantially as depicted and described herein, including various aspects, embodiments, configurations, subcombinations, and subsets thereof. Those of skill in the art will understand how to make and use the various aspects, aspects, embodiments, and configurations, after understanding the present disclosure. The present disclosure, in various aspects, embodiments, and configurations, includes providing devices and processes in the absence of items not depicted and/or described herein or in various aspects, embodiments, and configurations hereof, including in the absence of such items as may have been used in previous devices or processes, e.g., for improving performance, achieving ease and\or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more, aspects, embodiments, and configurations for the purpose of streamlining the disclosure. The features of the aspects, embodiments, and configurations of the disclosure may be combined in alternate aspects, embodiments, and configurations other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed aspects, embodiments, and configurations. Thus, the following claims are hereby incorporated into this Detailed Description, with each claim standing on its own as a separate preferred embodiment of the disclosure.

Moreover, though the description of the disclosure has included description of one or more aspects, embodiments, or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method, comprising:

at first location, receiving a treated feed material comprising a combustible, mercury-containing feed material and a halogen-containing additive; and transporting the treated feed material to a second location, the second location being located discretely from the first location, wherein the treated feed material is combusted at the second location to generate a waste gas comprising mercury and the halogen, the halogen enabling removal of at least most of the mercury from the waste gas.

2. The method of claim 1, wherein the halogen is one or more of iodine and bromine, wherein the feed material is coal, wherein the first location is a mine site, wherein the second location is a utility site, wherein the halogen is added in addition to any halogen occurring natively in the feed material, and wherein the transportation of the treated feed material is by one or more of rail car, truck, barge and ship.

3. The method of claim 1, wherein the halogen-containing additive is in the form of an agglomerate comprising a binder, a halogen compound, and a substrate.

4. The method of claim 3, wherein the substrate is a portion of the feed material.

5. The method of claim 3, wherein the treated feed material comprises a dust control agent to stabilize the halogen-containing additive during transportation.

6. The method of claim 3, wherein the treated feed material comprises a freeze control agent to stabilize the halogen-containing additive during transportation.

7. A method, comprising:

receiving, at an industrial facility, a treated feed material comprising a combustible, mercury-containing feed material and a halogen-containing additive, wherein the treated feed material was transported to the industrial facility from a remote location located discretely from the industrial facility; and combusting, by the industrial facility, the treated feed material to generate a waste gas comprising mercury and the halogen, the halogen enabling removal of at least most of the mercury from the waste gas.

8. The method of claim 7, wherein the halogen is one or more of iodine and bromine, wherein the feed material is coal, wherein the remote location is a mine site, wherein the industrial facility is a utility power plant, wherein the halogen is added substantially above the level of native halogen in the feed material, and wherein the transportation of the treated feed material is by one or more of rail car, truck, barge and ship.

9. The method of claim 7, wherein the halogen-containing additive is in the form of an agglomerate comprising a binder, a halogen compound, and a substrate.

10. The method of claim 9, wherein the substrate is a portion of the feed material.

11. The method of claim 9, wherein the treated feed material comprises a dust control agent to stabilize the halogen-containing additive during transportation.

12. The method of claim 9, wherein the treated feed material comprises a freeze control agent to stabilize the halogen-containing additive during transportation.

13. The method of claim 1, wherein the halogen comprises one or more of a halide and inter-halogen compound, wherein a selected halogen in the additive is at least about 50% above a level of the selected halogen natively in the treated feed material, wherein the selected halogen is one or more of iodine and bromine, and wherein the treated feed material, before additive addition, natively comprises from about 1 to about 100 ppm of the selected halogen.

14. The method of claim 1, wherein the first location is one or more of a transload facility located between a mine site and the second location and a coal blending location between the mine site and the second location and wherein at least about 75% of the additive in the treated feed material is contacted with the treated feed material at one or more locations remote from the second location.

15. The method of claim 7, wherein the halogen comprises one or more of a halide and inter-halogen compound, wherein a selected halogen in the additive is at least about 25% above a level of the selected halogen natively in the treated feed material, wherein the selected halogen is one or more of iodine and bromine, and wherein the treated feed material, before additive addition, natively comprises from about 5 to about 100 ppm of the selected halogen.

16. The method of claim 7, wherein the first location is one or more of a transload facility located between a mine site and the industrial facility and a coal blending location between the mine site and the industrial facility and wherein at least about 75% of the additive in the treated feed material is contacted with the treated feed material at one or more locations remote from the industrial facility.

17. A method, comprising:

receiving, at an industrial facility, a treated feed material comprising a combustible, mercury-containing feed material and a halogen-containing additive, wherein the treated feed material was transported to the industrial facility from a remote location located discretely from the industrial facility; and combusting, by the industrial facility, the treated feed material to generate a waste gas comprising mercury and the halogen, the halogen enabling removal of at least most of the mercury from the waste gas, wherein the halogen is one or more of iodine and bromine, wherein the feed material is coal, wherein the remote location is a mine site, wherein the industrial facility is a utility power plant, and wherein the treated feed material, before additive addition, natively comprises from about 5 to about 100 ppm of the selected halogen.

18. The method of claim 17, wherein the transportation of the treated feed material is by one or more of rail car, truck, barge and ship.

19. The method of claim 17, wherein the halogen-containing additive is in the form of an agglomerate comprising a binder, a halogen compound, and a substrate, wherein the substrate is a portion of the feed material, wherein the treated feed material comprises one or more of a dust control agent to stabilize the halogen-containing additive during transportation and a freeze control agent to stabilize the halogen-containing additive during transportation.

20. The method of claim 17, wherein the halogen comprises one or more of a halide and inter-halogen compound, wherein a selected halogen in the additive is at least about 50% above a level of the selected halogen natively in the treated feed material, wherein the selected halogen is one or more of iodine and bromine, and wherein the treated feed material, before additive addition, natively comprises from about 1 to about 100 ppm of the selected halogen.

* * * * *